US012492860B2

(12) United States Patent
Rajasekaran et al.

(10) Patent No.: US 12,492,860 B2
(45) **Date of Patent: *Dec. 9, 2025**

(54) SLIDABLE BIN WITHIN A REFRIGERATOR DRAWER

(71) Applicant: Transform SR Brands LLC, Hoffman Estates, IL (US)

(72) Inventors: Varun Prem Sagar Rajasekaran, Schaumburg, IL (US); Eva Christiansen, Huntley, IL (US); Lori Wood, Cary, IL (US)

(73) Assignee: Transform SR Brands LLC, Hoffman Estates, IL (US)

( * ) Notice: Subject to any disclaimer, the term of this patent is extended or adjusted under 35 U.S.C. 154(b) by 1071 days.

This patent is subject to a terminal disclaimer.

(21) Appl. No.: 16/430,099

(22) Filed: Jun. 3, 2019

(65) Prior Publication Data

US 2020/0041198 A1 Feb. 6, 2020

Related U.S. Application Data

(63) Continuation of application No. 13/953,436, filed on Jul. 29, 2013, now Pat. No. 10,365,032.

(51) Int. Cl.
*F25D 25/02* (2006.01)

(52) U.S. Cl.
CPC ..... *F25D 25/025* (2013.01)

(58) Field of Classification Search
CPC ..... F25D 25/025; F25D 25/024; A47B 88/20
USPC ..... 220/722, 720, 735, 751, 482, 481, 480, 220/549; 206/371
See application file for complete search history.

(56) References Cited

U.S. PATENT DOCUMENTS

| | | | | |
|---|---|---|---|---|
| 1,011,416 | A | | 12/1911 | Day |
| 2,326,087 | A | | 8/1943 | Rudolph |
| 2,579,895 | A | | 12/1951 | Anderssen |
| 2,751,272 | A | | 6/1956 | Hutzelman |
| 2,770,513 | A | | 11/1956 | Julius |
| 3,442,435 | A | | 5/1969 | Huston et al. |
| 3,477,679 | A | | 11/1969 | Lovitz |
| 3,868,021 | A | * | 2/1975 | Heinrich ..... E05D 15/0682 211/184 |
| 4,653,713 | A | | 3/1987 | Hamilton |
| 4,653,818 | A | | 3/1987 | Debruyn |
| 4,739,582 | A | | 4/1988 | Cullinane |
| 4,825,590 | A | | 5/1989 | Cullinane |
| 4,854,466 | A | | 8/1989 | Lane, Jr. |
| 4,944,566 | A | * | 7/1990 | Carper ..... F25D 25/02 312/246 |
| 4,995,337 | A | | 2/1991 | Abrams et al. |
| 5,039,264 | A | | 8/1991 | Benn |
| 5,385,230 | A | | 1/1995 | Nygard |
| 5,503,297 | A | | 4/1996 | Frankel |
| D376,558 | S | | 12/1996 | Elsea |
| 5,590,804 | A | | 1/1997 | Crum et al. |
| 5,660,298 | A | | 8/1997 | Thompson |
| 5,899,420 | A | | 5/1999 | Gerardi |
| 5,924,615 | A | | 7/1999 | McGarrah |

(Continued)

*Primary Examiner* — Jeffrey R Allen
(74) *Attorney, Agent, or Firm* — McAndrews, Held & Malloy, Ltd.

(57) ABSTRACT

A bin positioned within a refrigerator drawer and slidable across the refrigerator drawer at one or more edges of the refrigerator drawer and/or at one or more sliding mechanisms attached to at least one side of the refrigerator drawer.

19 Claims, 8 Drawing Sheets

(56) References Cited

U.S. PATENT DOCUMENTS

| | | | | |
|---|---|---|---|---|
| 6,076,700 | A | 6/2000 | Manges | |
| 6,082,537 | A | 7/2000 | Quinn | |
| 6,394,297 | B1 | 5/2002 | Nance | |
| D466,407 | S | 12/2002 | Nance | |
| 6,607,088 | B2 | 8/2003 | Cestrone | |
| 6,783,021 | B2 | 8/2004 | Kaura | |
| 6,837,383 | B1 | 1/2005 | McElhaney, Jr. | |
| 7,530,537 | B2 | 5/2009 | Kandah | |
| 8,047,397 | B2 | 11/2011 | Mittet | |
| 8,096,384 | B2 | 1/2012 | Caylor et al. | |
| 8,307,966 | B2 | 11/2012 | Cummins | |
| 8,418,309 | B1 | 4/2013 | Williams | |
| 8,443,996 | B2 | 5/2013 | Ciarrocchi, Jr. | |
| 8,448,813 | B2 | 5/2013 | Vanderberg et al. | |
| 8,517,483 | B2 | 8/2013 | Eubanks et al. | |
| 8,596,473 | B2 | 12/2013 | Newbould et al. | |
| 2001/0050283 | A1 | 12/2001 | Nance | |
| 2003/0019871 | A1 | 1/2003 | Nance | |
| 2006/0124647 | A1 | 6/2006 | Rosenberg et al. | |
| 2007/0035221 | A1* | 2/2007 | Koo | F25D 23/021 312/404 |
| 2008/0000910 | A1 | 1/2008 | Gaillard | |
| 2008/0302744 | A1 | 12/2008 | Rosenberg | |
| 2010/0051633 | A1 | 3/2010 | Porte et al. | |
| 2011/0084087 | A1 | 4/2011 | Scribner et al. | |
| 2011/0120173 | A1 | 5/2011 | Olefson | |
| 2011/0198362 | A1 | 8/2011 | Ciarrocchi, Jr. | |
| 2012/0299340 | A1 | 11/2012 | Krasley | |
| 2014/0138397 | A1 | 5/2014 | Ciarrocchi, Jr. | |
| 2014/0265802 | A1* | 9/2014 | Wilcox | F25D 25/025 312/404 |

* cited by examiner

SLIDABLE BIN WITHIN A REFRIGERATOR DRAWER

CROSS-REFERENCE TO RELATED APPLICATIONS/INCORPORATION BY REFERENCE

This application claims the benefit and is a continuation application of co-pending U.S. application Ser. No. 13/953,436, filed on Jul. 29, 2013, the disclosure of which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the invention relate to a bin operable to slide within a refrigerator drawer. More specifically, certain embodiments of the present invention relate to a bin positioned within a refrigerator drawer and slidable across the refrigerator drawer at one or more edges of the refrigerator drawer and/or at one or more sliding mechanisms attached to at least one side of the refrigerator drawer.

BACKGROUND OF THE INVENTION

FIG. 1 illustrates a front view of an exemplary refrigerator in a side by side configuration 100 as is known in the art. FIG. 2 illustrates a front view of an exemplary refrigerator in a French door bottom freezer configuration 200 as is known in the art. Referring to FIGS. 1-2 by way of example, existing refrigerators 100, 200 may include a refrigeration portion 110, 210 for maintaining a temperature above freezing and a freezer portion 120, 220 for maintaining a temperature below freezing. The refrigeration 110, 210 and freezer 120, 220 portions can each include compartments 130, 140, 230, 240 accessible by one or more doors 111, 211 or drawers, for example. The refrigeration 130, 230 and freezer 140, 240 compartments may have a variety of mechanisms for storing items, such as shelves 150, 250, drawers 160, 260, and the like. The refrigeration compartment can include one or more crisper drawers 161, 261, pantry drawers 262, and/or meat keeper drawers (not shown), for example. The crisper 161, 261, pantry 262, and/or meat keeper drawers (not shown) may generally be positioned near the bottom 131, 231 of the refrigeration compartment 130, 230 and can be slidably mounted to the sides 132, 133, 232, 233 of the refrigeration compartment or to an underside of a shelf 150, 250, which forms the top closure for the drawer 160, 260, for example. Recently, refrigerators 100, 200 have been growing in size and capacity. As the refrigerators 100, 200 increase in size and capacity, the components of the refrigerator, such as the drawers 160, 260, also increase in size and capacity. As the drawers 160, 260 within a refrigerator 100, 200 increase in size and capacity, small items are more difficult to quickly and easily locate and access.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

A bin positioned within a refrigerator drawer and slidable across the refrigerator drawer, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Figure 1:
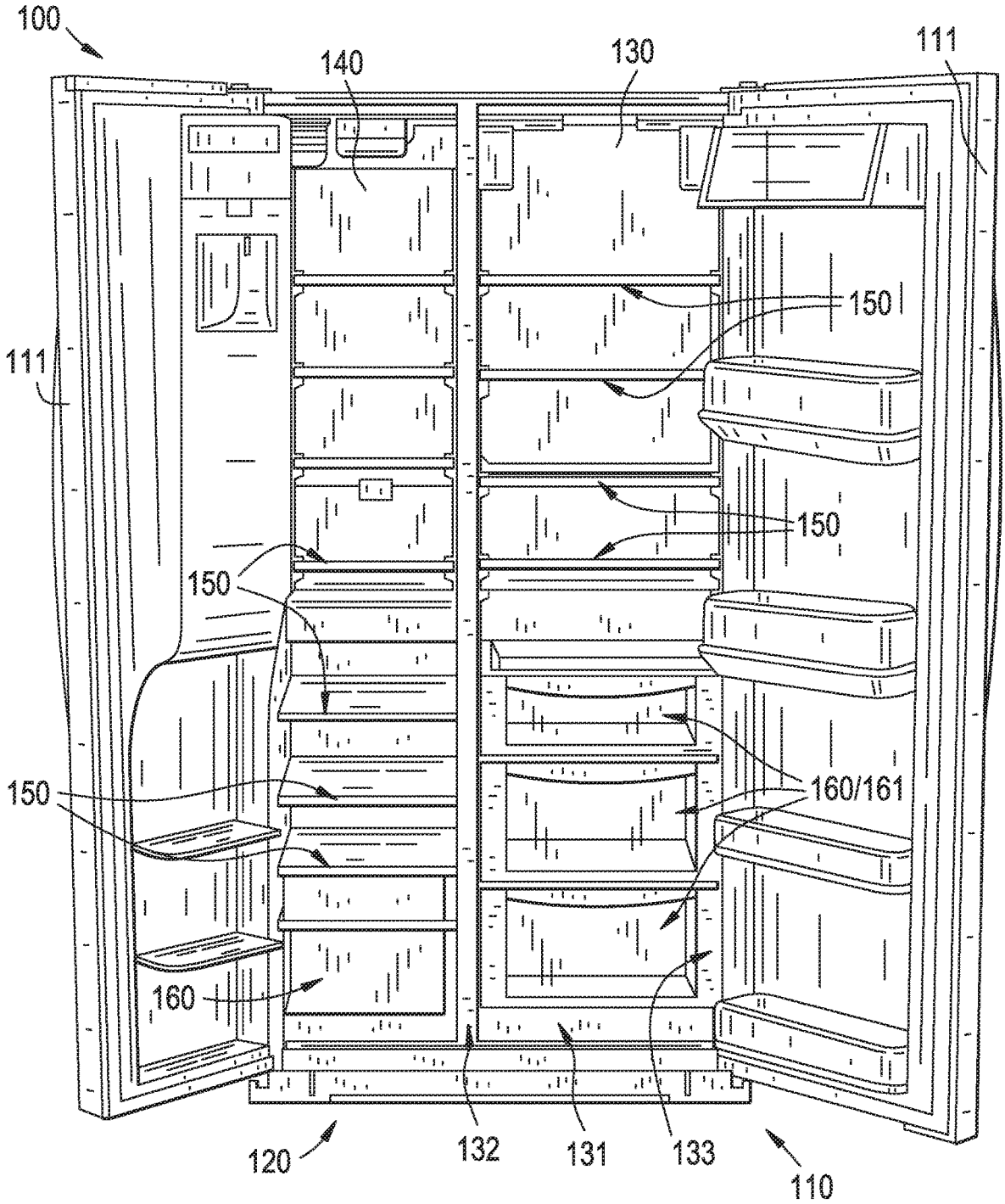
FIG. 1 PRIOR ART
FIG. 1 illustrates a front view of an exemplary refrigerator in a side by side configuration as is known in the art.

Aspects of the present invention are related to a bin operable to slide within a refrigerator drawer. More specifically, certain embodiments of the present invention relate to a bin positioned within a refrigerator drawer and slidable across the refrigerator drawer at one or more edges of the refrigerator drawer and/or at one or more sliding mechanisms attached to at least one side of the refrigerator drawer.

A representative embodiment of the present invention aids users of refrigerators with organizing and quickly identifying and accessing small items in refrigerator drawers by providing a slidable bin that can be slid out of the way when placing large items within the drawer or accessing large items from the drawer, for example.

Various embodiments provide a bin 320. In a representative embodiment of the present invention, the bin 320 comprises a bottom 321, at least one side 322, and at least one attachment mechanism 323. The bottom 321 comprises a perimeter edge. The at least one side 322 extends upward from the perimeter edge of the bottom 321. The at least one side 322 and the bottom 321 define a storage cavity of the bin 320. The at least one attachment mechanism 323 extends from the at least one side 322 and is operable to slidably couple to a refrigerator drawer 160, 161, 260, 261, 262, 310.

As utilized herein, the terms "exemplary" or "example" means serving as a non-limiting example, instance, or illustration. As utilized herein, the term "e.g." introduces a list of one or more non-limiting examples, instances, or illustrations.

Figure 2:
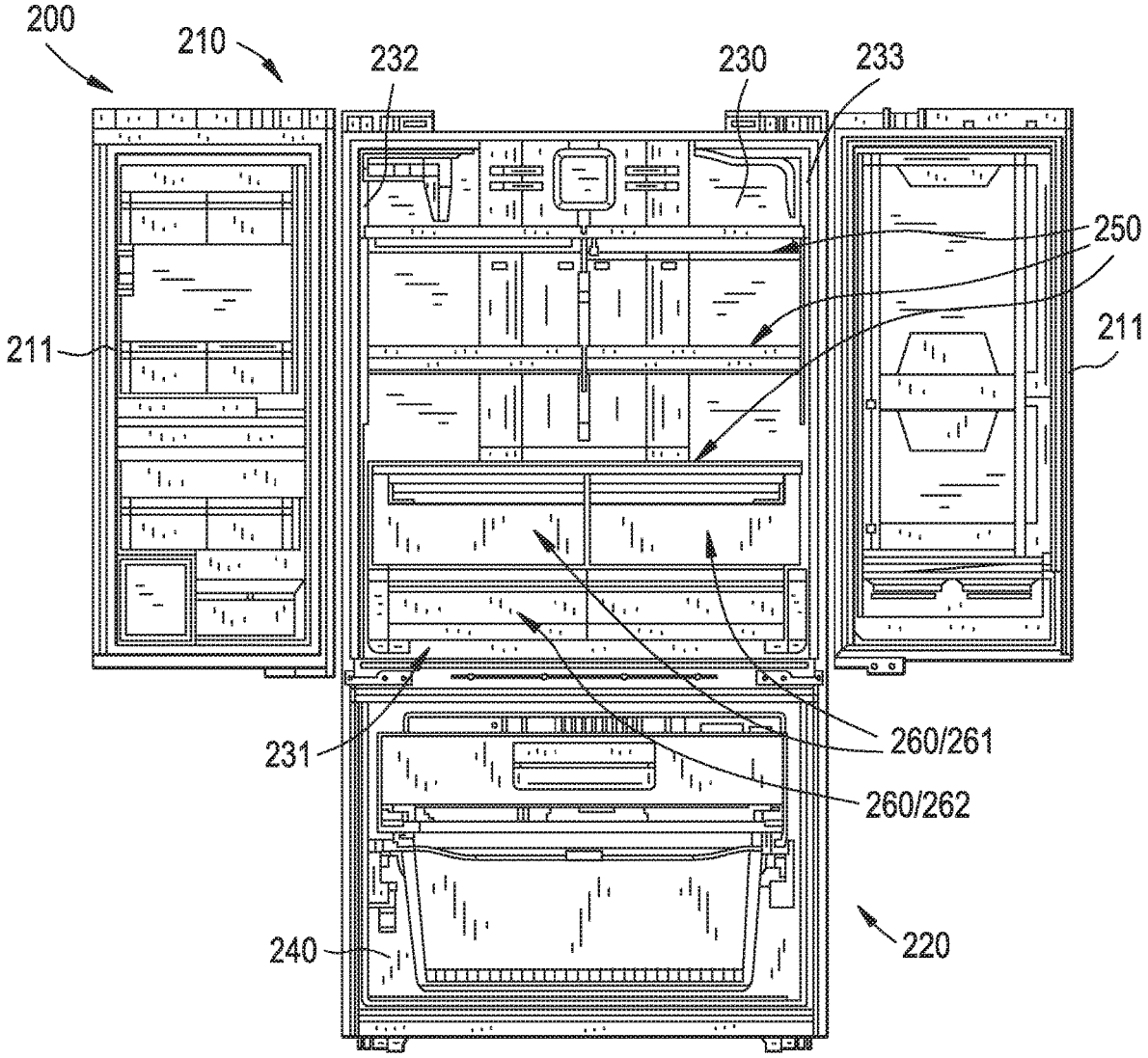
FIG. 2 PRIOR ART
FIG. 2 illustrates a front view of an exemplary refrigerator in a French door bottom freezer configuration as is known in the art.
Figure 3:
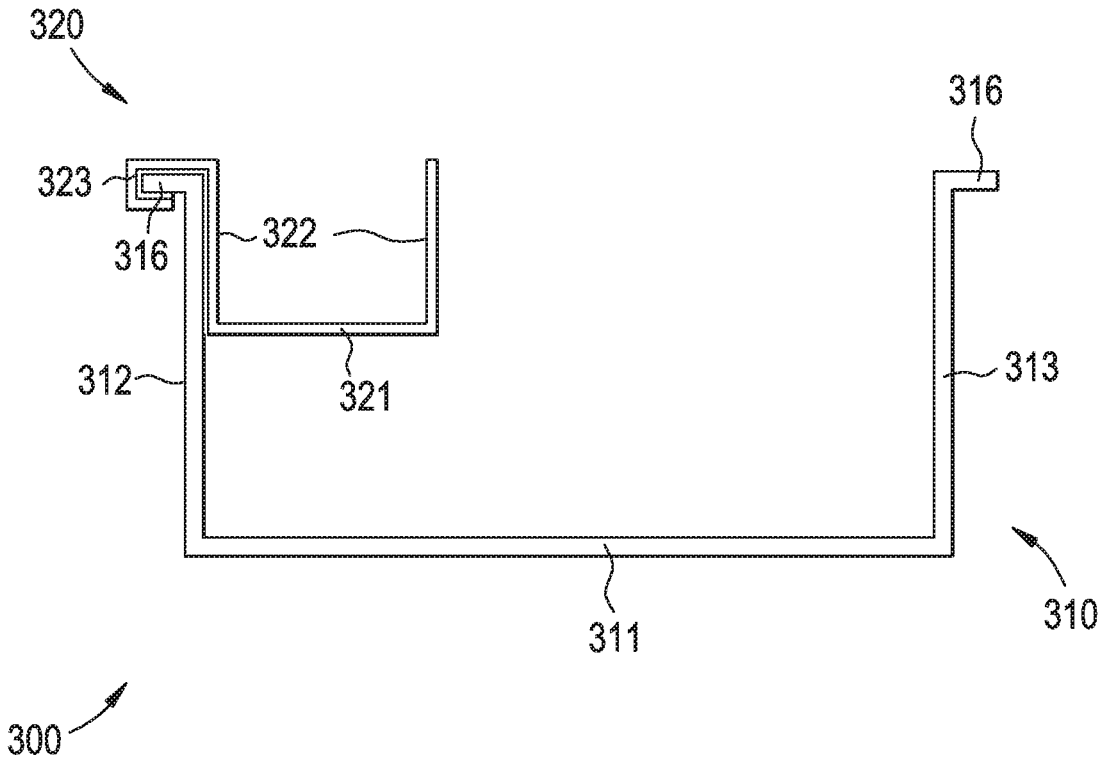
FIG. 3 illustrates a cross-sectional front elevation view of an exemplary bin positioned at an edge within a refrigerator drawer, in accordance with a representative embodiment of the present invention.
Figure 4:
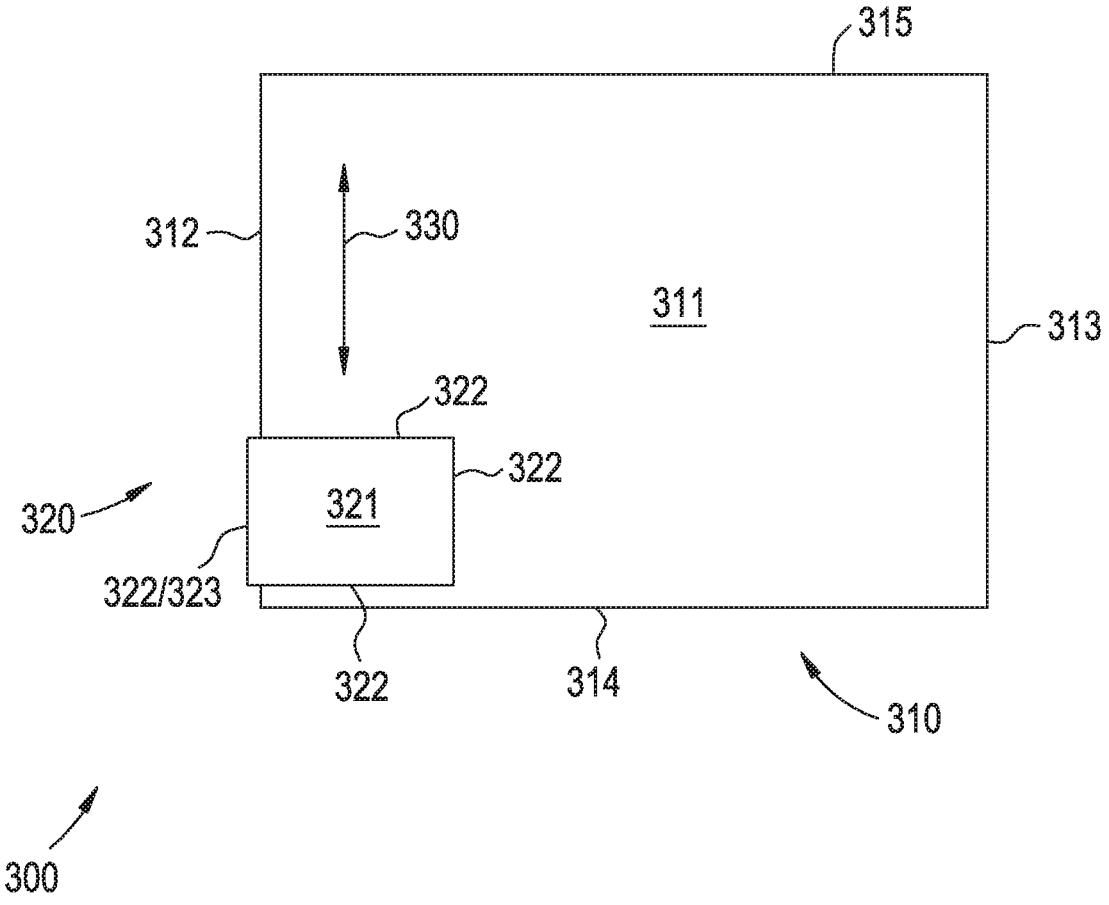
FIG. 4 illustrates a top elevation view of an exemplary bin positioned at an edge within a refrigerator drawer and slidable across the refrigerator drawer, in accordance with a representative embodiment of the present invention.

FIG. 3 illustrates a cross-sectional front elevation view of an exemplary bin 320 positioned at an edge 312 within a refrigerator drawer 310, in accordance with a representative embodiment of the present invention. FIG. 4 illustrates a top elevation view of an exemplary bin 320 positioned at an edge 312 within a refrigerator drawer 310 and slidable across the refrigerator drawer 310, in accordance with a representative embodiment of the present invention. Referring to FIGS. 3-4, a refrigerator storage system component 300 comprises a slidable bin 320 positioned within a refrigerator drawer 310. The refrigerator drawer 310 illustrated in FIGS. 3-4 may share various characteristics with the refrigerator drawers 160, 161, 260, 261, 262 illustrated in FIGS. 1-2 as described above. The refrigerator drawer 310 includes sides 312, 313, front 314, and back 315 walls that each extend upward from a perimeter edge of a bottom 311 to define a storage cavity of the drawer 310. Side wall 312 may be substantially parallel with side wall 313. Front wall 314 can be substantially parallel with back wall 315. The side walls 312, 313 may be substantially perpendicular with front 314 and back 315 walls.

In various embodiments, a top edge of one or more of the walls 312-315 can include an outward protrusion 316. In certain embodiments, the front wall 314 may include a handle for grasping to open and close the drawer 310, for example. The drawer 310 may be slidably mounted to the sides, 132, 133, 232, 233 of the refrigeration compartment or to an underside of a shelf 150, 250, which forms the top closure for the drawer 160, 260, 310, as illustrated in FIGS. 1-2, for example.

Referring again to FIGS. 3-4, the sliding bin 320 comprises a bottom 321 and side(s) 322 that extend upward from a perimeter edge of bottom 321 to define a storage cavity of the bin 320. Each side 322 of bin 320 may be respectively shorter than the walls 312-315 of drawer 310 such that the capacity of the bin storage cavity is less than the capacity of the drawer storage cavity and the bin 320 fits inside the drawer 310, for example. The bin sides 322 and bottom 321 can be plastic walls, wire mesh, or any suitable material. The bin 320 can be generally box-shaped, cylindrical, spherical, or any suitable shape. In various embodiments, the bin 320 can include a detachably coupleable cover (not shown).

The bin 320 comprises an attachment mechanism 323 operable to slidably couple to one or more of side walls 312, 313, front wall 314, and/or back wall 315 of the drawer 310. For example, the attachment mechanism 323 may be configured to slidably attach to a top edge or a protrusion 316 at a top edge of side wall 312 as illustrated in FIGS. 3-4. When slidably coupled to side wall 312, the bin 320 can be slidable along side wall 312 in directions 330 between the front wall 314 and the back wall 315 of the drawer 310, for example. Although FIGS. 3-4 illustrate the bin 320 being slidably coupled to side wall 312, the bin 320 may additionally and/or alternatively be coupled to side wall 313, front wall 314, and/or back wall 315, for example.

In certain embodiments, the attachment mechanism 323 can be integrated with or connected to a side 322 of the bin 320. In various embodiments, the attachment mechanism 323 can be a continuous hook portion that extends substantially the length of the bin side 322 or non-continuous hook portions along the length of bin side 322, the hook portion(s) configured to wrap over a top edge of the side wall 312 and/or an outward protrusion 316 of the side wall 312, for example. In certain embodiments, the size of the bin and bin storage cavity capacity may be adjustable by extending and contracting the bin. For example, the bin bottom 311 can be a two-piece construction where one piece of the bin bottom 311 can slide underneath a second piece of the bin bottom 311 to contract the bin 320 to a smaller size and/or pull out from underneath the second piece of the bin bottom 311 to expand the bin 320 to a larger size. Various embodiments provide that a lubricant such as grease or any suitable lubricant is applied between the side wall 312 of drawer 310 and the attachment mechanism 323 and/or bin side 322 to reduce friction between the side wall 312 and the attachment mechanism 323 and/or bin side 322 when sliding the bin 320.

Figure 5:
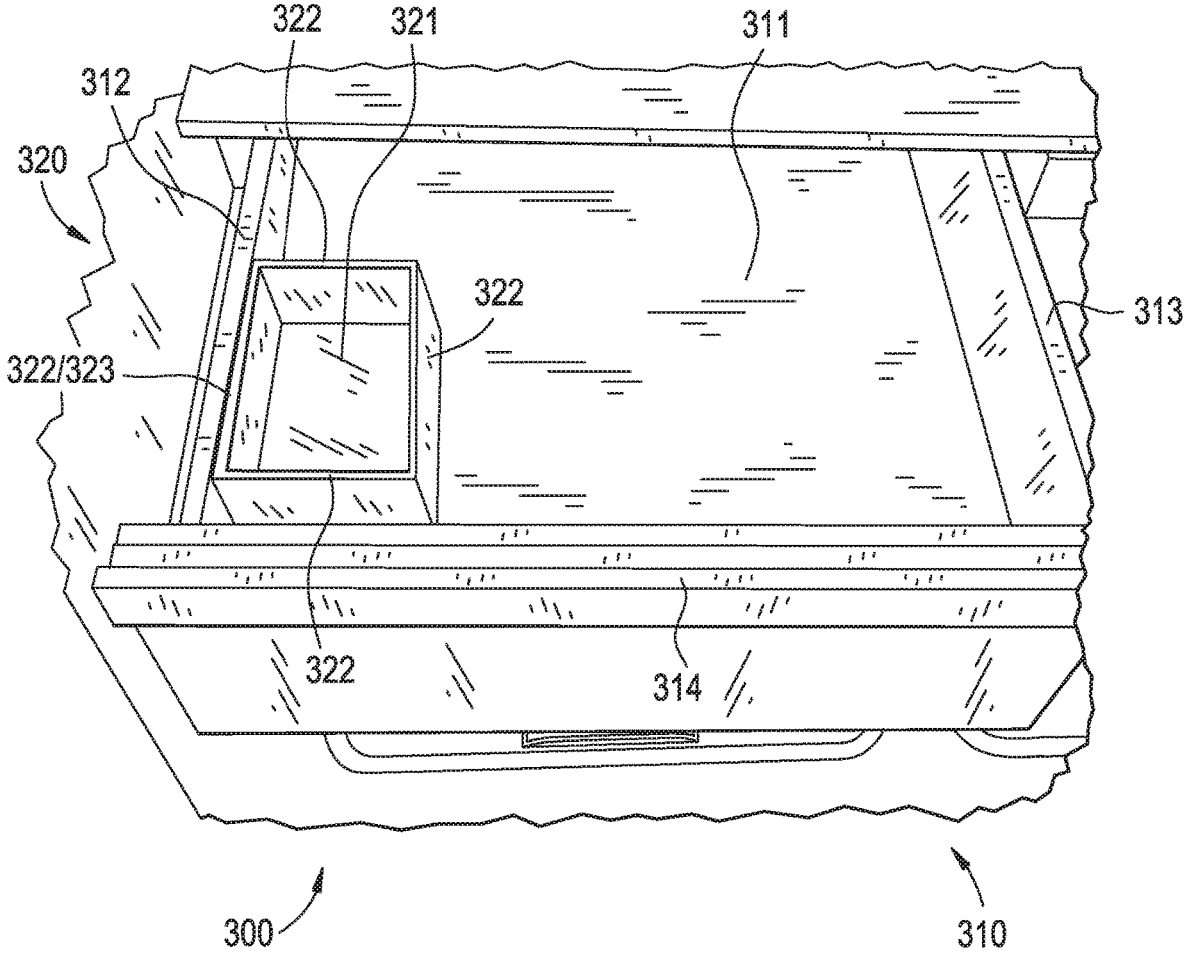
FIG. 5 illustrates a top front perspective view of an exemplary bin positioned within a refrigerator drawer, in accordance with a representative embodiment of the present invention.
Figure 6:
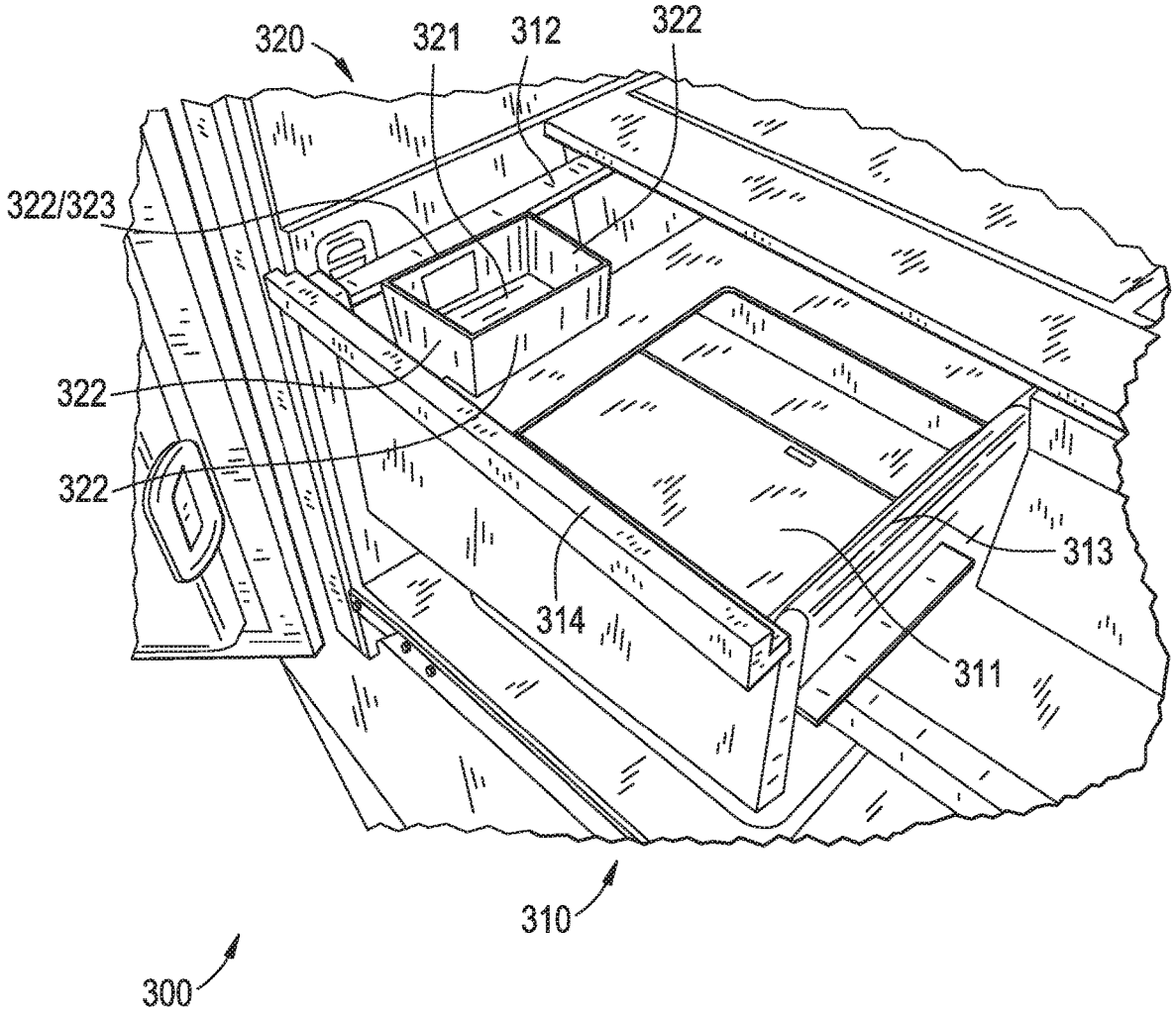
FIG. 6 illustrates a top side perspective view of an exemplary bin positioned within a refrigerator drawer, in accordance with a representative embodiment of the present invention.

FIG. 5 illustrates a top front perspective view of an exemplary bin 320 positioned within a refrigerator drawer 310, in accordance with a representative embodiment of the present invention. FIG. 6 illustrates a top side perspective view of an exemplary bin 320 positioned within a refrigerator drawer 310, in accordance with a representative embodiment of the present invention. Referring to FIGS. 5-6, a refrigerator storage system component 300 comprises a slidable bin 320 positioned within a refrigerator drawer 310. The refrigerator drawer 310 comprises sides 312, 313, front 314, and back 315 walls that each extend upward from a perimeter edge of a bottom 311 to define a storage cavity of the drawer 310. The sliding bin 320 comprises a bottom 321 and side(s) 322 that extend upward from a perimeter edge of bottom 321 to define a storage cavity of the bin 320. The bin 320 comprises an attachment mechanism 323 operable to slidably couple to one or more of side walls 312, 313, front wall 314, and/or back wall 315 of the drawer 310.

The refrigerator storage system component 300 illustrated in FIGS. 5-6 shares various characteristics with the refrigerator storage system component 300 illustrated in FIGS. 3-4 as described above.

Figure 7:
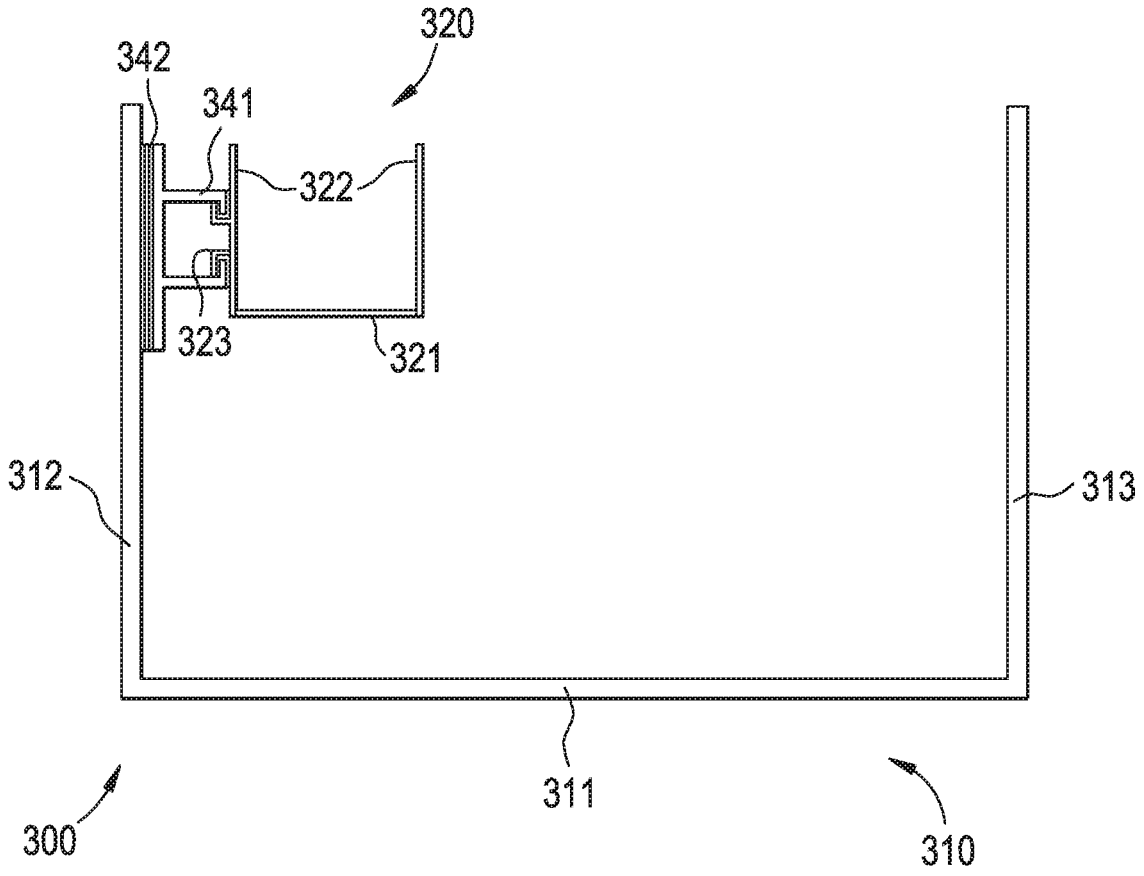
FIG. 7 illustrates a cross-sectional front elevation view of an exemplary bin slidably coupled to a receiving mechanism attached to a side within a refrigerator drawer, in accordance with a representative embodiment of the present invention.

FIG. 7 illustrates a cross-sectional front elevation view of an exemplary bin 320 slidably coupled to a receiving mechanism 341 attached to a side 312 within a refrigerator drawer 310, in accordance with a representative embodiment of the present invention. Referring to FIG. 7, a refrigerator storage system component 300 comprises a bin 320 slidably attached to a receiving mechanism 341 affixed within a refrigerator drawer 310. The refrigerator drawer 310 illustrated in FIG. 7 may share various characteristics with the refrigerator drawers 160, 161, 260, 261, 262, 310 illustrated in FIGS. 1-6 as described above. The refrigerator drawer 310 includes sides 312, 313, front 314, and back 315 walls that each extend upward from a perimeter edge of a bottom 311 to define a storage cavity of the drawer 310. The drawer 310 may be slidably mounted to the sides, 132, 133, 232, 233 of the refrigeration compartment or to an underside of a shelf 150, 250, which forms the top closure for the drawer 160, 260, 310, as illustrated in FIGS. 1-2, for example.

Referring again to FIG. 7, the sliding bin 320 comprises a bottom 321 and side(s) 322 that extend upward from a perimeter edge of bottom 321 to define a storage cavity of the bin 320. The bin 320 comprises an attachment mechanism 323 operable to slidably couple with a receiving mechanism 341 that may be affixed to one or more of side walls 312, 313, front wall 314, and/or back wall 315 of the drawer 310. The receiving mechanism 341 can be affixed to the wall(s) 312-315 with an affixing instrument 342, such as adhesive, screws, or any suitable affixing instrument. As illustrated in FIG. 7, the attachment mechanism 323 may be configured to slidably attach to a receiving mechanism 341 affixed to side wall 312, for example. When slidably coupled to the receiving mechanism 341 affixed to side wall 312, the bin 320 can be slidable along side wall 312 between the front and back walls of the drawer 310, for example. Although FIG. 7 illustrates the bin 320 being slidably coupled to a receiving mechanism 341 affixed to side wall 312, the bin 320 may additionally and/or alternatively be coupled to a receiving mechanism 341 affixed to any wall of the refrigerator drawer 310, for example.

In certain embodiments, the attachment mechanism 323 can be integrated with or connected to a side 322 of the bin 320. In various embodiments, the attachment mechanism 323 can be one or more protrusions that extend substantially the length of the bin side 322 and slidably interface with a receiving mechanism 341 that can be a slide rail affixed to and extending across the length of the side wall 312, for example. In certain embodiments, the size of the bin and bin storage cavity capacity may be adjustable by extending and contracting the bin. For example, the bin bottom 311 can be a two-piece construction where one piece of the bin bottom 311 can slide underneath a second piece of the bin bottom 311 to contract the bin 320 to a smaller size and/or pull out from underneath the second piece of the bin bottom 311 to expand the bin 320 to a larger size. Various embodiments provide that a lubricant such as grease or any suitable lubricant is applied between the attachment mechanism 323 and the receiving mechanism 341 to reduce friction between the attachment mechanism 323 and the receiving mechanism 341 when sliding the bin 320.

The refrigerator storage system component 300 illustrated in FIG. 7 shares various characteristics with the refrigerator storage system component 300 illustrated in FIGS. 3-6 as described above.

Figure 8:
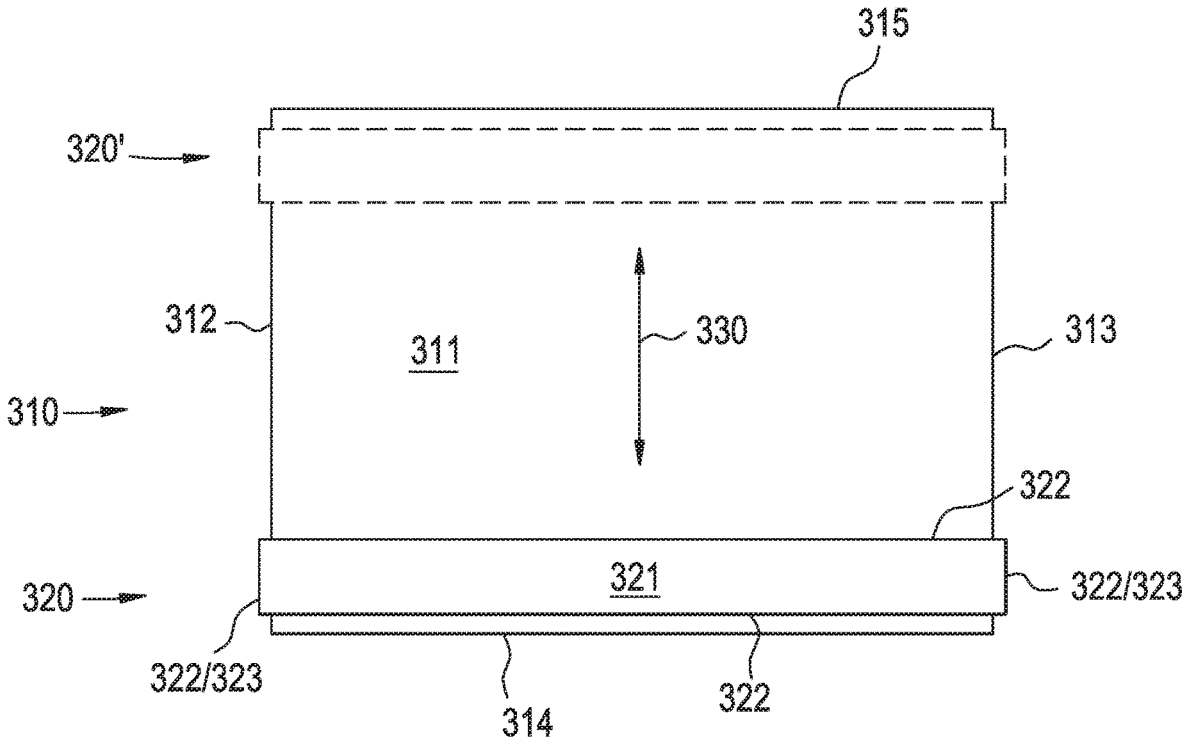
FIG. 8 illustrates a top elevation view of an exemplary bin positioned across opposite side edges within a refrigerator drawer and slidable across the refrigerator drawer, in accordance with a representative embodiment of the present invention.

FIG. 8 illustrates a top elevation view of an exemplary bin 320 positioned across opposite side edges 312, 313 within a refrigerator drawer 310 and slidable across the refrigerator drawer 310, in accordance with a representative embodiment of the present invention. Referring to FIG. 8, a refrigerator storage system component 300 comprises a slidable bin 320 positioned within a refrigerator drawer 310. The refrigerator drawer 310 illustrated in FIG. 8 may share various characteristics with the refrigerator drawers 160, 161, 260, 261, 262, 310 illustrated in FIGS. 1-7 as described above. The refrigerator drawer 310 includes sides 312, 313, front 314, and back 315 walls that each extend upward from a perimeter edge of a bottom 311 to define a storage cavity of the drawer 310. In certain embodiments, the front wall 314 may include a handle for grasping to open and close the drawer 310, for example. The drawer 310 may be slidably mounted to the sides, 132, 133, 232, 233 of the refrigeration compartment or to an underside of a shelf 150, 250, which forms the top closure for the drawer 160, 260, 310, as illustrated in FIGS. 1-2, for example.

Referring again to FIG. 8, the sliding bin 320 comprises a bottom 321 and side(s) 322 that extend upward from a perimeter edge of bottom 321 to define a storage cavity of the bin 320. The bin 320 comprises attachment mechanisms 323 operable to slidably couple to side walls 312, 313, or front 314 and back 315 walls, of the drawer 310. For example, the attachment mechanisms 323 may be configured to slidably attach to a top edge or a protrusion 316 at a top edge of side walls 312, 313, or front 314 and back 315 315 walls, similar to embodiments illustrated in FIGS. 3-4. As another example, the attachment mechanisms 323 can be configured to slidably attach to receiving mechanisms 341 affixed to side walls 312, 313, or front 314 and back 315 315 walls, similar to embodiments illustrated in FIG. 7. When slidably coupled to side walls 312, 313, the bin 320 can be slidable along side walls 312, 313 in directions 330 between the front wall 314 and the back wall 315 of the drawer 310, for example. As an example, the bin 320 can be slidable from the illustrated position to position 320' and to positions in between the illustrated position and position 320'. Although FIG. 8 illustrate the bin 320 being slidably coupled to side walls 312, 313, various embodiments provide that the bin 320 may be coupled to front 314 and back 315 walls, for example.

In certain embodiments, the attachment mechanisms 323 can be integrated with or connected to sides 322 of the bin 320. In various embodiments, the attachment mechanisms 323 can be continuous hook portions that extend substantially the length of opposing bin sides 322 or non-continuous hook portions along the length of opposing bin sides 322, the hook portions configured to wrap over a top edge of the side walls 312, 313 and/or an outward protrusion 316 of the side walls 312, 313, similar to embodiments illustrated in FIGS. 3-4, for example. As another example, the attachment mechanisms 323 can be one or more protrusions that extend substantially the length of opposing bin sides 322 and slidably interface with receiving mechanisms 341 that can be a slide rail affixed to and extending across the length of the side walls 312, 313, or front 314 and back 315 walls, similar to embodiments illustrated in FIG. 7, for example. In certain embodiments, a lubricant such as grease or any suitable lubricant is applied between the attachment mechanisms 323 and the receiving mechanisms 341 or walls 312-315 of drawer 310 to reduce friction when sliding the bin 320.

Various embodiments provide that the size of the bin 320 and bin storage cavity capacity may be adjustable by extending and contracting the bin 320. For example, the bin bottom 311 can be a two-piece construction where one piece of the bin bottom 311 can slide underneath a second piece of the bin bottom 311 to contract the bin 320 to a smaller size and/or pull out from underneath the second piece of the bin bottom 311 to expand the bin 320 to a larger size.

The refrigerator storage system component 300 illustrated in FIG. 8 shares various characteristics with the refrigerator storage system component 300 illustrated in FIGS. 3-7 as described above.

In operation, a bin 320 can be purchased as an accessory or built-into one or more drawers 160, 161, 260, 261, 262, 310 of a refrigerator 100, 200. The bin 320 comprises a bottom 321 and side(s) 322 that extend upward from a perimeter edge of bottom 321 to define a storage cavity of the bin 320. The bin 320 is smaller than the refrigerator drawer 160, 161, 260, 261, 262, 310 so that the bin 320 is positioned within the refrigerator drawer 160, 161, 260, 261, 262, 310 to store small items in the bin storage cavity. The bin 320 is slidably attached to a wall 312-315 or to two opposing parallel walls 312-313, 314-315 of a refrigerator drawer 160, 161, 260, 261, 262, 310. The bin 320 comprises an attachment mechanism(s) 323 for slidably coupling the bin 320 to the wall(s) 312-315 or to a receiving mechanism 341 affixed to the wall(s) 312-315. A user of the refrigerator 100, 200 may open a drawer 160, 161, 260, 261, 262, 310 having a bin 320 and slide the bin 320 to a position that is convenient to either (a) store or retrieve large items in the storage cavity of the drawer 160, 161, 260, 261, 262, 310, or (b) store or retrieve small items in the storage cavity of the bin 320, for example. In various embodiments, the bin 320 may include a cover that can be opened or removed before storing or retrieving small items in the bin storage cavity and closed or replaced after storing or retrieving small items in the bin storage cavity.

Aspects of the present invention may be seen in a bin 320. In a representative embodiment of the present invention, the bin 320 comprises a bottom 321, at least one side 322, and at least one attachment mechanism 323. The bottom 321 comprises a perimeter edge. The at least one side 322 extends upward from the perimeter edge of the bottom 321. The at least one side 322 and the bottom 321 define a storage cavity of the bin 320. The at least one attachment mechanism 323 extends from the at least one side 322 and is operable to slidably couple to a refrigerator drawer 160, 161, 260, 261, 262, 310.

In various embodiments, the at least one attachment mechanism 323 is configured to slidably couple to one or more of a top edge and a protrusion 316 at the top edge of at least one wall 312-315 of the refrigerator drawer 160, 161, 260, 261, 262, 310. In certain embodiments, the at least one attachment mechanism 323 is two attachment mechanisms 323 extending from two opposite sides 322 of the bin 320. The two attachment mechanisms 323 are configured to slidably couple to one or more of the top edge and the protrusion 316 at the top edge of two parallel and opposite walls 312-313, 314-315 of the refrigerator drawer 160, 161, 260, 261, 262, 310. In a representative embodiment of the present invention, the at least one attachment mechanism 323 comprises a hook portion configured to wrap over one or more of the top edge and the protrusion 316 at the top edge of the at least one wall 312-315 of the refrigerator drawer 160, 161, 260, 261, 262, 310. In various embodiments, the bin 320 is slidable along the at least one wall 312-315 in directions 330 between two opposing walls 312-313, 314-315 of the refrigerator drawer 160, 161, 260, 261, 262, 310 that are perpendicular to the at least one wall 312-315. In certain embodiments, the bin comprises a lubricant applied between the at least one attachment mechanism 323 and one or more of the top edge and the protrusion 316 at the top edge of the at least one wall 312-315 of the refrigerator drawer 160, 161, 260, 261, 262, 310.

In a representative embodiment of the present invention, the bin 320 comprises at least one receiving mechanism 341. The at least one attachment mechanism 323 is configured to slidably attach to the at least one receiving mechanism 341 affixed to at least one wall 312-315 of the refrigerator drawer 160, 161, 260, 261, 262, 310. In various embodiments, the at least one attachment mechanism 323 is two attachment mechanisms 323 extending from two opposite sides 322 of the bin 320. The at least one receiving mechanism 341 is two receiving mechanisms 341, each of the two receiving mechanisms 341 corresponding to a different one of the two attachment mechanisms 323. The two receiving mechanisms 341 are affixable to opposite walls 312-313, 314-315 of the refrigerator drawer 160, 161, 260, 261, 262, 310. Each of the two attachment mechanisms 323 are configured to slidably couple to a corresponding one of the two receiving mechanisms 341. In certain embodiments, the at least one receiving mechanism 341 is affixed to the at least one wall 312-315 of the refrigerator drawer 160, 161, 260, 261, 262, 310 by an adhesive 342. In a representative embodiment of the present invention, the at least one attachment mechanism 323 comprises at least one protrusion configured to slide within a slide rail of the receiving mechanism 341 that extends across the length of the at least one wall 312-315 of the refrigerator drawer 160, 161, 260, 261, 262, 310. In various embodiments, the bin 320 is slidable along the at least one receiving mechanism 341 in directions 330 between two opposing walls 312-313, 314-315 of the refrigerator drawer 160, 161, 260, 261, 262, 310 that are perpendicular to the at least one wall 312-315. In a representative embodiment of the present invention, the bin 320 comprises a lubricant applied between the at least one attachment mechanism 323 and the at least one receiving mechanism 341.

In certain embodiments, the bin 320 comprises a cover detachably coupleable to the at least one side 322. In various embodiments, the bottom 321 and the at least one side 322 is one or more of plastic and wire mesh. In a representative embodiment of the present invention, the bin 320 is one or more of generally box-shaped, cylindrical, and spherical. In certain embodiments, a capacity of the storage cavity is adjustable by extending and contracting the bin 320. In various embodiments, the bottom 321 is a two-piece construction. A first piece of the bottom 321 can slide in underneath a second piece of the bottom 321 to contract the bin 320, and the first piece of the bottom 321 can slide out from underneath the second piece of the bottom 321 to extend the bin 320.

Although devices, methods, and systems according to the present invention may have been described in connection with a preferred embodiment, it is not intended to be limited to the specific form set forth herein, but on the contrary, it is intended to cover such alternative, modifications, and equivalents, as can be reasonably included within the scope of the invention as defined by this disclosure and appended diagrams.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A refrigerator comprising:

a refrigeration compartment;

a drawer slidably mounted within the refrigeration compartment, the drawer comprising a drawer front wall having a handle, a drawer back wall opposite the drawer front wall, two drawer side walls, and a drawer bottom, wherein an inside surface of one or more of the drawer front wall, the drawer back wall, and two drawer side walls is affixed with a slide rail; and a bin comprising:

a bottom comprising a perimeter edge;

at least one side extending upward from the perimeter edge of the bottom, the at least one side and the bottom defining a storage cavity of the bin; and at least one protrusion extending from an outer surface of the at least one side of the bin and slidably coupled to the slide rail of the drawer such that the at least one protrusion slidably coupled to the slide rail of the drawer suspends the bottom of the bin above the drawer bottom;

wherein the bin is fully contained within the drawer front wall, the drawer back wall, and the two drawer side walls, and wherein the bin is operable to slide along the slide rail within the drawer.

2. The refrigerator of claim 1, wherein:

the at least one protrusion comprises one or more protrusions extending from each of two opposite sides of the bin, the inside surface of both of the two drawer side walls is each affixed with a respective one of the slide rail, the one or more protrusions extending from a first of the two opposite sides of the bin is slidably coupled to the side rail affixed to a first of the two drawer side walls, and the one or more protrusions extending from a second of the two opposite sides of the bin is slidably coupled to the side rail affixed to a second of the two drawer side walls.

3. The refrigerator of claim 1, wherein:

the at least one protrusion comprises one or more protrusions extending from each of two opposite sides of the bin, the inside surface of both of the drawer front wall and the drawer back wall is affixed with the slide rail, the one or more protrusions extending from a first of the two opposite sides of the bin is slidably coupled to the side rail affixed to the drawer front wall, and the one or more protrusions extending from a second of the two opposite sides of the bin is slidably coupled to the side rail affixed to the drawer back wall.

4. The refrigerator of claim 1, wherein the slide rail is affixed to the inside surface of one or more of the drawer front wall, the drawer back wall, and two drawer side walls by an adhesive.

5. The refrigerator of claim 1, wherein the slide rail extends across the length of the drawer front wall, and wherein the bin is slidable along the slide rail in directions between the two drawer side walls.

6. The refrigerator of claim 1, wherein the slide rail extends across the length of the drawer back wall, and wherein the bin is slidable along the slide rail in directions between the two drawer side walls.

7. The refrigerator of claim 1, wherein the slide rail extends across the length of one of the drawer side walls, and wherein the bin is slidable along the slide rail in directions between the drawer front wall and the drawer back wall.

8. The refrigerator of claim 1, wherein each of the drawer front wall and the drawer back wall is affixed with the slide rail, and wherein the bin is slidable along the slide rails between the two drawer slide walls.

9. The refrigerator of claim 1, wherein each of the two drawer side walls is affixed with the slide rail, and wherein the bin is slidable along the slide rails between the drawer front wall and the drawer back wall.

10. The refrigerator of claim 1, comprising a lubricant applied between the slide rail and the at least one protrusion.

11. The refrigerator of claim 1, comprising a cover detachably coupleable to the at least one side of the bin.

12. The refrigerator of claim 1, wherein the bottom and the at least one side of the bin is at least one of:

plastic, and wire mesh.

13. The refrigerator of claim 1, wherein the bin is at least one of:

generally box-shaped, cylindrical, and spherical.

14. The refrigerator of claim 1, wherein a capacity of the storage cavity is adjustable by extending and contracting the bin.

15. The refrigerator of claim 14, wherein the bottom of the bin is a two-piece construction, wherein a first piece of the bottom can slide in underneath a second piece of the bottom to contract the bin, and the first piece of the bottom can slide out from underneath the second piece of the bottom to extend the bin.

16. The refrigerator of claim 1, wherein only the drawer front wall is affixed with the slide rail, and wherein the bin is slidable along the slide rail between the two drawer slide walls.

17. The refrigerator of claim 1, wherein only the drawer back wall is affixed with the slide rail, and wherein the bin is slidable along the slide rail between the two drawer slide walls.

18. The refrigerator of claim 1, wherein only one of the two drawer side walls is affixed with the slide rail, and wherein the bin is slidable along the slide rail between the drawer front wall and the drawer back wall.

19. The refrigerator of claim 1, wherein only one of the two drawer side walls is affixed with the slide rail, and wherein the bin is slidable along the slide rail between the drawer front wall and the drawer back wall.

* * * * *